US009481036B2

(12) United States Patent
Bal et al.

(10) Patent No.: US 9,481,036 B2
(45) Date of Patent: Nov. 1, 2016

(54) METHOD FOR FABRICATING BIOCOMPATIBLE POROUS TITANIUM

(71) Applicant: THE CURATORS OF THE UNIVERSITY OF MISSOURI, Columbia, MO (US)

(72) Inventors: B. Sonny Bal, Columbia, MO (US); Tieshu Huang, Columbia, MO (US); Mohamed N. Rahaman, Columbia, MO (US)

(73) Assignee: The Curators of the University of Missouri, Columbia, MO (US)

( * ) Notice: Subject to any disclaimer, the term of this patent is extended or adjusted under 35 U.S.C. 154(b) by 246 days.

(21) Appl. No.: 14/362,751

(22) PCT Filed: Dec. 10, 2012

(86) PCT No.: PCT/US2012/068770

§ 371 (c)(1),
(2) Date: Jun. 4, 2014

(87) PCT Pub. No.: WO2013/086504

PCT Pub. Date: Jun. 13, 2013

(65) Prior Publication Data

US 2014/0348688 A1 Nov. 27, 2014

Related U.S. Application Data

(60) Provisional application No. 61/630,344, filed on Dec. 9, 2011.

(51) Int. Cl.

| | |
|---|---|
| ***B22F 3/11*** | (2006.01) |
| ***C22C 14/00*** | (2006.01) |
| *B22F 9/04* | (2006.01) |

(52) U.S. Cl.
CPC ..... *B22F 3/1121* (2013.01); *B22F 3/1134* (2013.01); *C22C 14/00* (2013.01); *B22F 2009/043* (2013.01); *B22F 2998/00* (2013.01)

(58) Field of Classification Search
CPC ..... B22F 3/1121; C22C 14/00
See application file for complete search history.

(56) References Cited

U.S. PATENT DOCUMENTS

| | | | | |
|---|---|---|---|---|
| 2,657,127 | A * | 10/1953 | Sindeband | B22F 9/00 419/35 |
| 2006/0002810 | A1* | 1/2006 | Grohowski | A61F 2/30767 419/2 |
| 2008/0199720 | A1* | 8/2008 | Liu | A61C 13/0022 428/613 |
| 2010/0015463 | A1* | 1/2010 | Siak | B22F 1/0003 428/558 |
| 2010/0150767 | A1* | 6/2010 | Dunand | B22F 3/1103 419/2 |

* cited by examiner

*Primary Examiner* — Jessee Roe
*Assistant Examiner* — Christopher Kessler
(74) *Attorney, Agent, or Firm* — Polsinelli PC

(57) ABSTRACT

A method for fabricating porous metal constructs (such as porous Ti constructs) which may be used as implants in bone repair is disclosed. The method employs a new saltbath sintering process coupled with conventional powder metallurgy technology which is capable of fabricating porous metal constructs with controlled porosity and pore size having a lower production cost than conventional powder metallurgy methods.

20 Claims, 4 Drawing Sheets

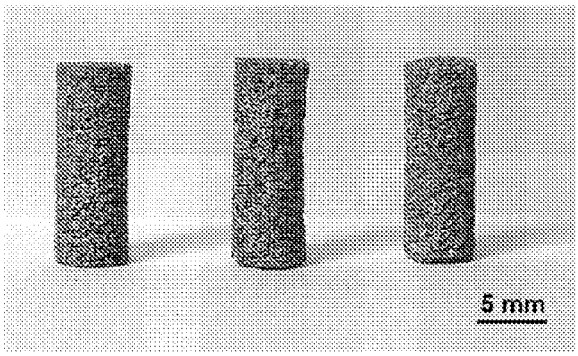
FIG. 1A
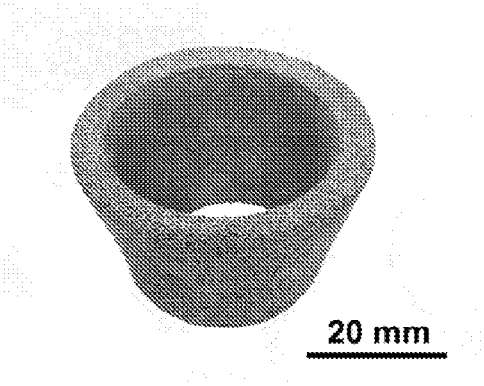
FIG. 1B
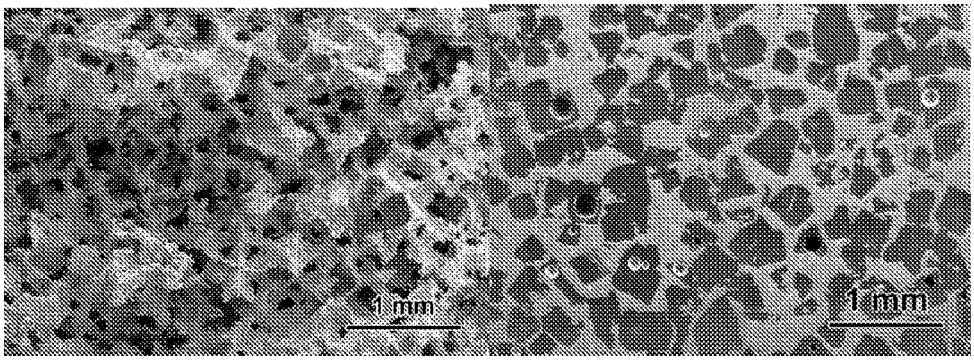
FIG. 2A
FIG. 2B 2 days 4 days 6 days 2 days 4 days 6 days

METHOD FOR FABRICATING BIOCOMPATIBLE POROUS TITANIUM

CROSS-REFERENCE TO RELATED APPLICATIONS

The present application claims priority to U.S. Provisional Application No. 61/630,344 filed on Dec. 9, 2011, the entire contents and disclosure of which are herein incorporated by reference.

FIELD

The present invention relates to a method for fabricating a porous metal construct, and in particular to a fabrication method for a biocompatible porous titanium construct, which employs a salt bath sintering process.

BACKGROUND

Titanium (Ti) is widely used as an implant material in dental and orthopedic applications because of its biocompatibility, corrosion resistance, and mechanical durability. Commercial-purity, dense Ti has one of the smallest elastic modulus values (100-110 GPa) among the metallic materials commonly used as implants in the biomedical industry; however, its modulus is still far larger than that of human cortical bone (10-15 MPa). It is well documented that the use of implants with elastic modulus values far larger than that of bone can lead to undesirable bone resorption resulting from stress shielding.

Modification of the microstructure and macro-shape is a widely-used approach for controlling the mechanical properties of solids. For a given macro-shape, modification of the pore characteristics such as the porosity, pore size, and distribution in the pore size provides a method for altering the mechanical properties. Porosity is also important in implant applications; an implant should have the requisite pore characteristics to support tissue in-growth and integration with host tissues. Generally, interconnected pores of size larger than 100 μm have been reported to be beneficial for supporting bone in-growth.

Because of the importance of porosity in implant applications, the production of porous Ti has been the subject of several investigations in the last few decades. The methods include conventional powder metallurgy, solid freeform fabrication (e.g., selective electron beam melting and three-dimensional printing), sintering of powders, tape casting, and foam replication techniques. For example, a conventional powder metallurgy method involves compacting Ti particles in a die, and sintering the construct in a vacuum or inert gas atmosphere to bond the Ti particles into a strong network. However, this method provides only a limited range of porosity (approximately 30 to 50%) which makes it difficult to match the mechanical properties of bone. Another method, the polymer foam replication technique, involves the steps of (1) coating a polymer foam with Ti (or $TiH_2$) particles, (2) decomposing the foam in a vacuum, and (3) sintering the construct in a vacuum to bond the Ti particles. This method requires decomposing a large mass of polymer foam in a high-vacuum furnace which is detrimental to a high-vacuum furnace, particularly when fabricating a large article. Organic space holder methods employ carbamide, ammonium hydrogen carbonate, or other materials as a space holder in the fabrication. The major drawback of these methods is the removal of the organic space holders which generate environmentally hazardous vapors. The rapid prototyping methods can fabricate highly controlled pore structure and pore size distribution, but they require expensive equipment.

More recently, hierarchically-structured Ti foams have been produced by first forming an oxide precursor by a gel-casting method, followed by electrochemical reduction. Current production of most reactive metals by a powder metallurgy route involves a controlled-atmosphere sintering step in which a compacted mass of particles is heated in a vacuum or in a high-purity inert gas atmosphere to bond the particles. However, the use of a vacuum furnace or an inert gas atmosphere furnace leads to high fabrication costs.

Therefore, there is a need to provide a new and improved method for fabricating porous titanium with controlled pore sizes, wide porosity range, and low-cost process.

SUMMARY

In one embodiment, a method for fabricating porous metal construct, such as titanium, with the requisite porosity, pore sizes for biomedical applications and reduced fabrication cost is provided. The method for fabricating a porous metal construct with desired porosity may include the steps of (1) mixing metal powder and salt particles and forming a metal-salt construct by pressing in a shaped die; (2) sintering the metal-salt construct in a molten salt bath at an elevated temperature to produce a sintered construct with a bonded network of metal; and (3) removing salt from the sintered construct by dissolution in water to result in the porous metal construct. The amount of salt and the particle size of the salt can be monitored and varied to control the porosity and pore size of the resulting porous construct. The inventive methods may also be applied to metals other than Ti, such as Nb, Zr, Ta, W, and stainless steel.

Additional objectives, advantages and novel features will be set forth in the description which follows or will become apparent to those skilled in the art upon examination of the drawings and detailed description which follows.

BRIEF DESCRIPTION OF THE DRAWINGS

FIGS. 1A and 1B are pictures of exemplary Titanium (Ti) constructs fabricated using an embodiment of the inventive method;

FIGS. 2A and B are Scanning Electron Microscopy (SEM) images of the surface and polished cross section, respectively, of an exemplary porous Ti construct;

Figure 3:
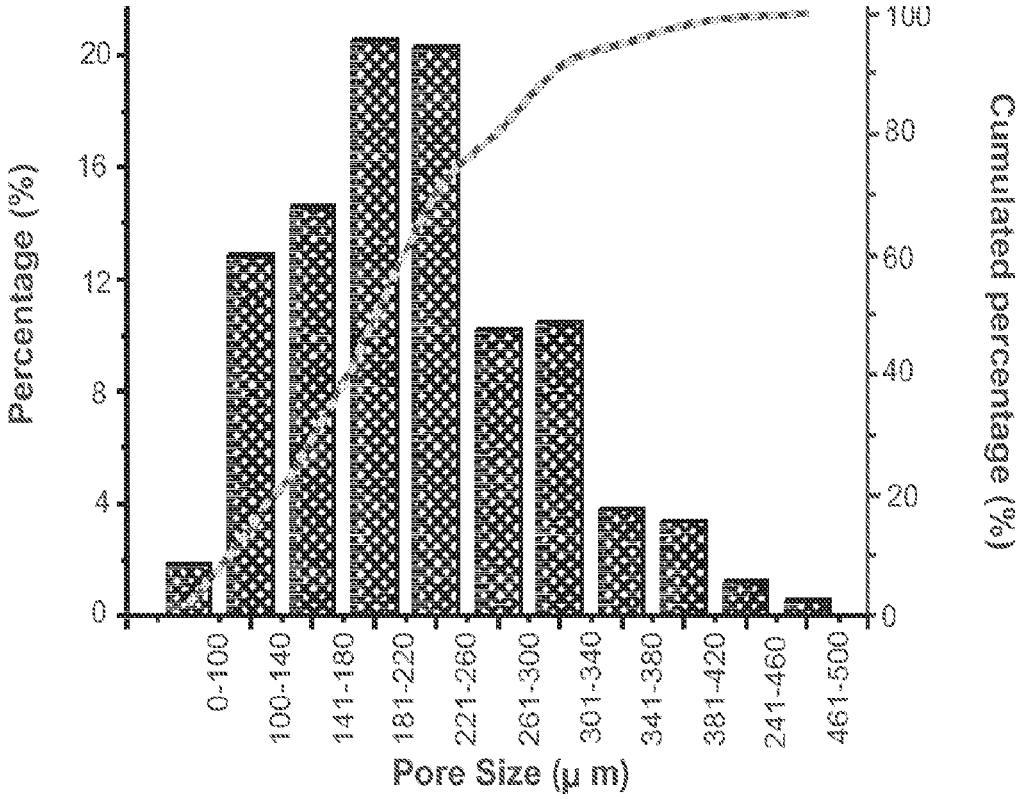
FIG. 3 shows the pore size distribution and cumulative fraction of pores in a fabricated Ti construct with a porosity of 65%.

The headings used in the figures should not be interpreted to limit the scope of the claims.

DETAILED DESCRIPTION

Unless other wise defined, all technical and scientific terms used herein have the same meaning as commonly understood by one of ordinary skill in the art to which this invention belongs. All publications, patent application, patents, and other references mentioned herein are incorporated by reference in their entirety.

The invention provides a new method for fabricating porous metal constructs, such as titanium (Ti) constructs for biomedical applications, such as implants for the repair of diseased or damaged bone. The inventive fabrication method combines a new salt-bath sintering technology with a conventional powder metallurgy process. The sintering step is performed in a molten salt bath to eliminate the need for expensive furnaces in which the sintering step is performed in a vacuum or in a high-purity inert gas atmosphere. Thus, the inventive method can significantly reduce the production cost when compared to conventional powder metallurgy methods. The inventive method is capable of controlling the porosity and pore size of the fabricated metal constructs by varying the volume ratio of salt to metal, and the size of the salt particles. An additional advantage of the inventive method is that the linear shrinkage of the construct, from the forming stage to the final product, is lower than that for constructs fabricated by conventional powder metallurgy methods; the lower shrinkage makes it easier to control the dimensions of the final product. Moreover, the method may also be employed to fabricating porous metal constructs other than Ti, such as Niobium (Nb), Zirconium (Zr), Tantalum (Ta), Tungstun (W), stainless steel, etc.

Specifically, the inventive method comprises three major steps: (1) mixing metal powder and salt particles in the predetermined ratio and forming a metal-salt construct with the desired shape by pressing in a shaped die, (2) sintering the metal-salt construct in a molten salt bath at an elevated temperature to produce a sintered construct with a strong network of bonded metal particles, and (3) removing salt from the sintered construct by dissolution in water to result in the porous metal construct with the desired porosity and pore size.

In the mixing and forming step, the inventive method may further include the sub-steps of (i) dry mixing the metal powder and salt particles to form a dry powder mixture, (ii) wet mixing the metal powder and salt particles by adding an organic solvent into the dry mixture, along with agitation to result in a moist mixture with improved homogeneity of mixing, and (iii) pressing the moist mixture in a shaped die to form a metal-salt construct with the desired shape and improved strength. The ratio of the metal powder to the salt particles and the size of the salt particles are important for producing constructs with the desired porosity, pore size, and distribution of pore sizes. Sodium chloride is commonly employed as the salt in the process, but chlorides of other metals, such as potassium chloride (KCl), can be used. The organic solvent employed in the wet-mixing may be ketones (such as acetone), alcohols (such as isopropanol), hydrocarbons (such as hexane), etc., which have the desired evaporation rate for ease of removal. For example, acetone at a ratio of 1:100 by weight of the dry mixture may be used, and it later evaporates during the pressing step.

In the sintering step, the salt bath may be heated at a rate of 0.1 to 100° C./min up to a temperature in the range 900 to 1400° C. and kept at the temperature for the requisite period of time (0 to several hours). After this sintering step, the normal cooling-down process to room temperature may also be controlled at a rate of 0.1 to 100° C./min.

The inventive method is capable of producing porous metal constructs with porosities in the range 30 to 80%, and pore sizes in the range 10 to 1000 μm by controlling the ratio of metal powder to salt particles and the size of the salt particles. Table 1 compares the different Ti to salt volume ratios in the starting mixture with the corresponding porosities in the fabricated constructs.

TABLE I

Composition and properties of starting materials and fabricated Ti constructs

| | Starting mixture (vol %) | | Fabricated Ti constructs | | |
|---|---|---|---|---|---|
| Sample | Ti | NaCl | Porosity (%) | Yield strength (MPa) | Elastic modulus (GPa) |
| 1 | 65 | 35 | 35 | 216 ± 29 | 9.8 ± 2.0 |
| 2 | 60 | 40 | 40 | 154 ± 11 | 6.0 ± 0.2 |
| 3 | 50 | 50 | 50 | 114 ± 7 | 4.6 ± 0.4 |
| 4 | 45 | 55 | 55 | 83 ± 9 | 4.0 ± 0.8 |
| 5 | 35 | 65 | 65 | 36 ± 15 | 1.8 ± 0.8 |

Ti constructs with porosities in the range 35 to 65% are readily produced by the inventive method. Constructs with porosity higher than 65% may be achieved, but at the expense of reduced strength.

The invention has also evaluated the physical, microstructural, and mechanical properties of the fabricated constructs. The evaluations show that the fabricated constructs have the requisite mechanical properties to match the strength and elastic modulus of bone, so bone resorption due to "stress shielding" may be reduced.

Physical property: Referring to FIGS. 1A and 1B, which show pictures of exemplary porous Ti constructs fabricated using the inventive method; FIG. 1A shows three cylindrical constructs, while FIG. 1B shows a hollow truncated conical construct. Visual comparison of the fabricated constructs with the starting Ti particles showed no marked difference in color, which indicates that oxidation of the Ti construct did not occur during the salt-bath sintering step.

As shown in FIGS. 1A and 1B, the constructs retained their shape during the fabrication process. During the sintering step, the pores between the Ti particles in the Ti-salt article are eliminated, leading to a dense, strong Ti phase and interconnected salt particles. The shrinkage during the sintering step is 6 to 10%, which is lower than the typical 15% shrinkage observed in this step for conventional powder metallurgy methods. The lower shrinkage in this inventive method makes it easier to control the dimensions of the final product, such as the product shown in FIG. 1B.

Microstructural property: Referring now to FIG. 2, which shows SEM images of the surface and polished cross section of an exemplary construct. The surface and polished cross section are shown to have a uniform porous microstructure with a dense Ti phase resulting from sintering of the Ti particles and interconnected pores that mimicked the size and cubic shape of the salt particles.

Referring now to FIG. 3, which shows the measured pore size distribution of an exemplary construct with 65% porosity. More than 90% of pores in the exemplary construct have a size in the range between 100 to 420 μm, which has been shown to be a desirable pore size range for bone repair/replacement.

Figure 4:
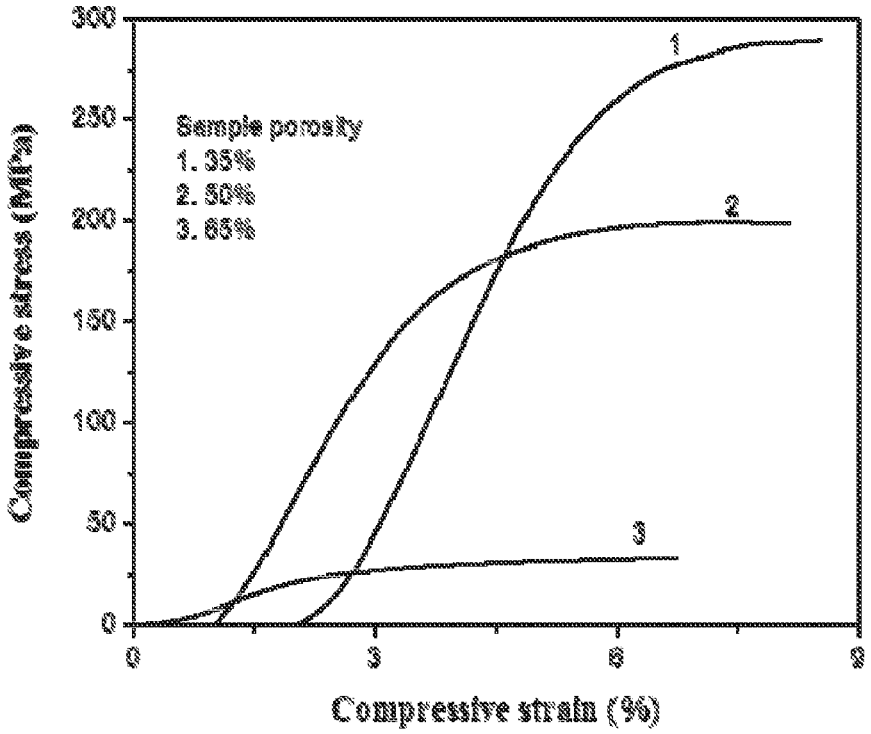
FIG. 4 shows the mechanical response (compressive stress vs. strain) for porous Ti constructs with the porosities shown.

Mechanical property: Referring now to FIG. 4, which shows the mechanical response in compression for fabricated Ti constructs with porosities of 35, 50, and 65%. The shapes of the curves show the typical deformation behavior of a ductile metal. The yield stress, a measure of the strength of the construct, is defined as the stress at an offset strain of 0.2%; the elastic modulus, a measure of the stiffness of the construct, is defined as the slope of the initial linear region of the stress vs. strain curve.

Figure 5:
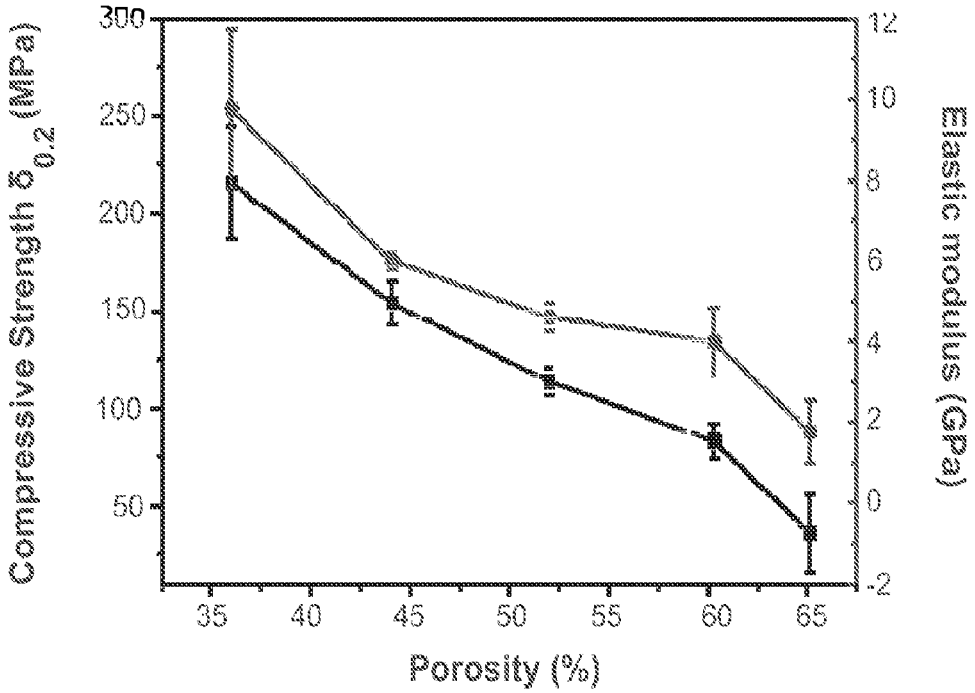
FIG. 5 shows the yield strength and elastic modulus in compression for porous Ti constructs as a function of porosity.

Referring to FIG. 5, the measured compressive strength and elastic modulus of the Ti constructs as a function of porosity is shown. The compressive strength decreases from 216±29 MPa to 36±15 MPa, while the elastic modulus decreases from 9.8±2.0 GPa to 1.8±0.8 GPa as the porosity increases from 35 to 65%. The data for the strength and elastic modulus show approximately the same trend with decrease in porosity.

Figure 6:
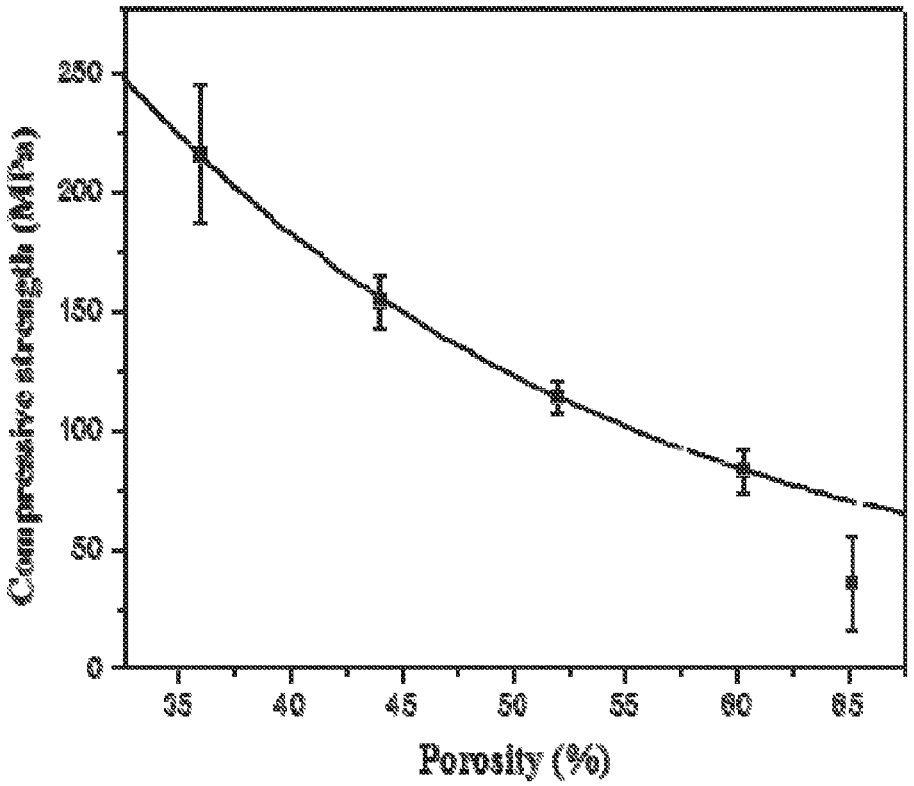
FIG. 6 shows data for the compressive yield strength vs. porosity for the fabricated Ti constructs fitted using an exponential relationship (Equation 1); the fit shows that the mechanical properties can be controlled and predicted.

Referring now to FIG. 6, a fit of the measured strength vs. porosity data of the fabricated Ti constructs with a theoretical relationship is illustrated. In the porosity range 35 to 65% which is a desirable range for bone repair, the theoretical relationship is:

$$\sigma=15.0+975\ \exp(-0.044P) \quad (1)$$

where σ is the compressive strength, and P is the porosity of the construct. The ability to fit the measured data using Equation (1) means that the strength of the fabricated Ti construct can be predicted from the porosity; alternatively, the porosity for a required strength can be predicted.

The invention has further tested the response of the fabricated Ti constructs to cells in vitro, and found that the fabricated constructs are biocompatible. In addition, the results showed that the fabricated Ti constructs have the requisite porosity and pore size to support cell growth into the implants, which is a requirement for porous implants intended for bone repair applications.

Figure 7A:
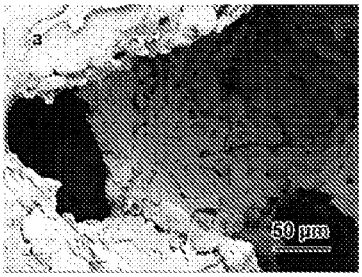
FIGS. 7A to 7F are images of porous Ti constructs seeded with osteogenic MLO-A5 cells and incubated in vitro for 2, 4 and 6 days: 7A to 7C SEM images; 7D to 7F optical images of the Ti constructs treated with an MTT assay. The increase in cell proliferation, as seen from the SEM images and from the MTT staining (purple), shows that the fabricated constructs are biocompatible.
Figure 7B:
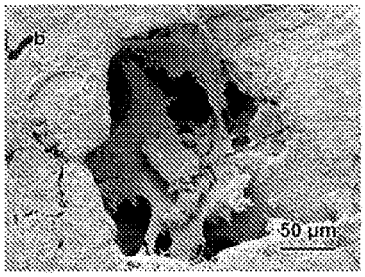
Figure 7C:
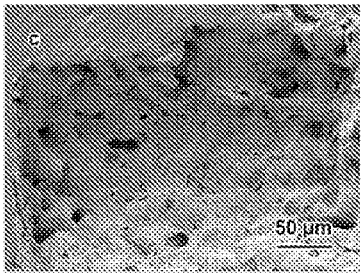
Figure 7D:
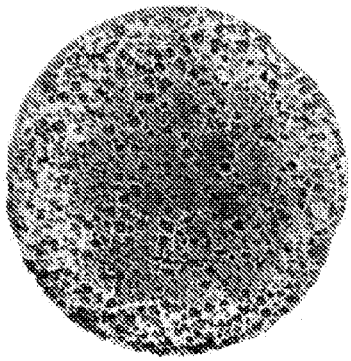
Figure 7E:
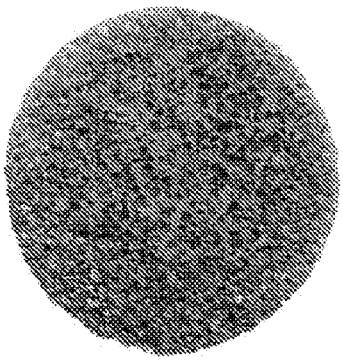
Figure 7F:
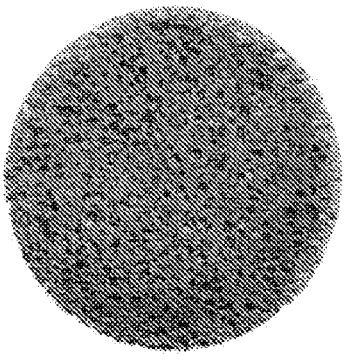

Referring to FIGS. 7A to 7C, SEM images illustrate the morphology of osteogenic MLO-A5 cells seeded on the surfaces of the porous Ti constructs and incubated for 2, 4 and 6 days. The osteogenic cells appeared to be well attached to the surface of the construct. In addition, the number of cells on the construct increased as a function of incubation time, showing that the fabricated Ti constructs can support proliferation of the osteogenic cells. After culturing for 6 days, almost the whole surface of the construct, including the surface of the pores, was covered with cells. Photographic images of cell-seeded constructs treated using an MTT assay are shown in FIGS. 7D to 7F. The purple pigment visible on the scaffold is an indication of viable cells. The increase in intensity of the purple color with culture time provides further evidence for the capacity of the fabricated Ti constructs to support the proliferation of viable, metabolically active cells.

EXAMPLE

The following discussion is intended only as an example of some embodiments of the invention. The details set forth below are not intended to limit the scope of the disclosure, but are rather to provide an example of the use of an embodiment of the invention.

The process begins with mixing and compaction of the starting materials. The starting materials may include commercially-available Titanium (Ti) sponge powder with an average particle size <45 microns (μm) and sodium chloride (NaCl or salt) particles with an average size of 200-500 μm. The starting materials were obtained by sieving biomedical grade starting materials through stainless steel sieves to provide starting materials of the desired size. Different ratios of Ti and salt, by volume, were used to fabricate final Ti constructs with porosity values in the range of approximately 35-65%.

The starting materials were mixed using a mechanical mixing method, which includes grinding using a mortar and pestle or tumbling the starting materials in a ball mill. Specifically, the Ti and salt particles were initially mixed in a dry state by tumbling the mixture in a vessel (e.g., a Nalgene® bottle) for approximately 12 hours. Dry mixing was followed by wet mixing, which consisted of stirring the mixture for approximately one minute in acetone, which improved the homogeneity of mixing. The ratio of the solid phase (i.e., the Ti and salt) to the acetone was approximately 100:1 by weight.

After mixing, the moist mixture was compacted in a shaped die (e.g., in any desired shape). In this experiment, the moist mixture was uniaxially pressed (e.g., using a press, such as a hydraulic press) in a 6.35 mm diameter stainless steel die under a pressure of 20 MPa. In other experiments, pressures of between about 60 MPa to about 100 MPa were used. After pressing, the acetone was allowed to completely or nearly completely evaporate. After evaporation of the acetone, the die-pressed materials were then pressed again using a cold isostatic press under a pressure of about 250 MPa to increase the strength of the materials. During the compaction process, the Ti particles adhere to other Ti particles by plastic flow to produce a construct with sufficient strength for manipulation. As a result, constructs were formed into the required configuration or geometry (e.g., cylinder, tube, spherical, etc.), depending on the shape of the die.

After compacting the materials, the construct was sintered in a salt-bath. The salt bath can be provided using a salt-bath furnace or an alumina crucible in a vented chamber furnace. Specifically, in this case, a chamber furnace was used such that an alumina crucible was partially filled with salt particles and heated at 10° C./min to the desired sintering temperature (e.g., around 1200° C.). After reaching the sintering temperature and upon the salt melting, the compacted mixture was put into the salt bath in an expedient manner to avoid some or all potential oxidizing. After the compacted mixture was placed in the salt bath, the temperature was held constant for about 1 to about 3 hours to sinter the metallic network of Ti particles. In this case, the temperature was held constant for about 2 hours. After completion of sintering, the now-sintered construct was cooled in the salt bath. In situations using a salt bath-sintering furnace, the sintered construct was cooled using quenching via oil to protect the sintered material from oxidization.

After the sintering process, the salt was removed from the sintered construct. As discussed above, the salt acts a pore-forming phase so that the removal of the salt works to reveal the pores of the final material. In this case, the salt was removed by dissolution achieved by soaking the sintered construct (i.e., the Ti/salt material) in water at a temperature near or greater than room temperature (e.g., around 21° C.). Completion of the dissolution process was determined by testing for the presence of $Cl^-$ ions in the water by adding one or more volumes of silver nitrate solution to the water. When there was no observable precipitation of silver chloride, the sintered mixture was removed from the water, washed with deionized water, and dried for 24 h at 65° C. After salt removal, porous Ti scaffolds with the desired microstructure (e.g., porosity of between about 60% and about 70% and pore sizes between about 100 and about 500 microns) and desired mechanical properties was produced.

Using some alternative systems, other methods were used to remove the salt from the sintered construct. For example, in one system, the sintered mixture was placed on a porous substrate or surrounded with a porous powder bed and heated above the melting point of the salt (i.e., around 801° C.) in an inert atmosphere (e.g., in the presence of an inert gas, such as Argon). As a result, the salt became molten and was removed by wicking. In other systems, the salt was removed via a combination the processes disclosed above (i.e., wicking and dissolution).

While the invention has been described in connection with specific embodiments thereof, it will be understood that the inventive device is capable of further modifications. This patent application is intended to cover any variations, uses, or adaptations of the invention following, in general, the principles of the invention and including such departures from the present disclosure as come within known or customary practice within the art to which the invention pertains and as may be applied to the essential features herein before set forth.

What is claimed is:

1. A method for fabricating biocompatible porous metals, the method comprising:

mixing a metal powder and a salt to form a mixture;

compacting the mixture in a die under pressure to form a construct comprising a predetermined shape; and sintering the construct in a molten sodium chloride bath to produce a sintered construct.

2. The method of claim 1 and further comprising soaking the sintered construct in a water bath to remove at least a portion of the salt to reveal a plurality of pores within the sintered construct.

3. The method of claim 1, wherein mixing the metal power and the salt comprises a dry-mixing step and a wet-mixing step.

4. The method of claim 3, wherein the dry-mixing step comprises mixing the metal powder and the salt in a tumbler for a predetermined amount of time to form a dry mix.

5. The method of claim 4, wherein the wet-mixing step comprises mixing the dry mix with a volume of acetone to form the mixture.

6. The method of claim 1, wherein the metal comprises at least one of titanium, niobium, zirconium, tantalum, tungsten, and stainless steel.

7. The method of claim 1, wherein the salt comprises at least one of sodium chloride and potassium chloride.

8. The method of claim 1, wherein the molten sodium chloride bath comprises liquid sodium chloride at a temperature of at least 1200° C. in an alumina crucible.

9. The method of claim 1, wherein the construct is sintered in the molten sodium chloride bath for between about 1 and about 3 hours.

10. A method for fabricating biocompatible porous titanium, the method comprising:

mixing a titanium powder and a salt to form a mixture;

compacting the mixture in a die under pressure to form a construct comprising a predetermined shape;

sintering the construct in a molten sodium chloride bath to produce a sintered construct; and removing at least a portion of the salt from the sintered construct to reveal a plurality of pores defined through a portion of the sintered construct.

11. The method of claim 10, wherein removing at least a portion of the salt from the sintered construct comprises soaking the sintered construct in a water bath.

12. The method of claim 10, wherein removing at least a portion of the salt from the sintered construct comprises heating the sintered construct to a temperature greater than a melting temperature of the salt.

13. The method of claim 10, wherein the salt comprises one of sodium chloride and potassium chloride.

14. The method of claim 10, wherein mixing the titanium power and the salt comprises a dry-mixing step and a wet-mixing step.

15. The method of claim 14, wherein the dry-mixing step comprises mixing the metal powder and the salt in a tumbler for a predetermined amount of time to form a dry mix.

16. The method of claim 15, wherein wet-mixing step comprises mixing the dry mix with a volume of acetone to form the mixture.

17. The method of claim 10, wherein the molten sodium chloride bath comprises liquid sodium chloride at a temperature of at least 1200° C. in an alumina crucible.

18. The method of claim 17, wherein sintering the construct comprises raising the temperature of the molten sodium chloride bath at a rate of between 0.1 to 100° C. per minute.

19. The method of claim 18, wherein the rate is approximately 10° C. per minute.

20. The method of claim 10, wherein the construct is sintered in the molten sodium chloride bath for between about 1 and about 3 hours.

* * * * *